US011114052B2

(12) United States Patent
Zhang

(10) Patent No.: US 11,114,052 B2
(45) Date of Patent: Sep. 7, 2021

(54) COMMON VOLTAGE FEEDBACK COMPENSATION CIRCUIT, METHOD, AND FLAT DISPLAY DEVICE

(71) Applicant: Shenzhen China Star Optoelectronics Semiconductor Display Technology Co., Ltd., Shenzhen (CN)

(72) Inventor: Xianming Zhang, Shenzhen (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 392 days.

(21) Appl. No.: 16/312,283

(22) PCT Filed: Sep. 29, 2018

(86) PCT No.: PCT/CN2018/108587
§ 371 (c)(1),
(2) Date: Dec. 21, 2018

(87) PCT Pub. No.: WO2020/000746
PCT Pub. Date: Jan. 2, 2020

(65) Prior Publication Data

US 2021/0118346 A1 Apr. 22, 2021

(30) Foreign Application Priority Data

Jun. 29, 2018 (CN) ..... 201810712855.5

(51) Int. Cl.
*G09G 3/36* (2006.01)

(52) U.S. Cl.
CPC ... *G09G 3/3655* (2013.01); *G09G 2310/0291* (2013.01); *G09G 2330/025* (2013.01)

(58) Field of Classification Search
None
See application file for complete search history.

(56) References Cited

U.S. PATENT DOCUMENTS

2010/0277399 A1 11/2010 Yu et al.

FOREIGN PATENT DOCUMENTS

CN 1983376 A 6/2007
CN 102842280 A 12/2012
(Continued)

OTHER PUBLICATIONS

Translated CN105654888A ; Zhang Jian; Common electrode voltage compensating circuit and display device; Publication : CN105654888A•Jun. 8, 2016 (Year: 2016).*

*Primary Examiner* — Amr A Awad
*Assistant Examiner* — Donna V Bocar
(74) *Attorney, Agent, or Firm* — Leong C. Lei

(57) ABSTRACT

The utility model relates to a voltage conditioning circuit, and particularly relates to an AD voltage conditioning circuit. The conditioning circuit comprises a voltage-dividing circuit and a voltage translation circuit. The voltage-dividing circuit and the voltage translation circuit share an output end. The voltage-dividing circuit and the voltage translation circuit are integrated together and share the output end so that the voltage-dividing circuit and the voltage translation circuit can be isolated without using an isolation circuit, AD voltage can be conditioned to an appropriate value, three arithmetic units required to be used by an original conditioning circuit is reduced to only two arithmetic units, and four resistors required to be used by the voltage-dividing circuit and the translation circuit of the original conditioning circuit are reduced to only three resistors. Therefore, the circuit is simplified, cost is greatly reduced and assembling efficiency of circuit boards is enhanced in batch production.

8 Claims, 2 Drawing Sheets

(56) References Cited

FOREIGN PATENT DOCUMENTS

| | | | |
|---|---|---|---|
| CN | 203825080 | U | 9/2014 |
| CN | 105513527 | A | 4/2016 |
| CN | 105632395 | A | 6/2016 |
| CN | 105654888 | A | 6/2016 |
| CN | 108172190 | A | 6/2018 |

* cited by examiner

COMMON VOLTAGE FEEDBACK COMPENSATION CIRCUIT, METHOD, AND FLAT DISPLAY DEVICE

FIELD OF THE INVENTION

The present disclosure relates to a display field, and more particularly to a common voltage feedback compensation circuit, a method, and a flat display device.

BACKGROUND OF THE INVENTION

With the size of the display panel has become much greater, the current of the common voltage VCOM of the common electrode used in the panel has also become greater. When the grayscale is switched, the common voltage VCOM may have a voltage drop in the panel, and the interference, resulting from switching the grayscale, may have a great influence on the common voltage VCOM.

The common voltage VCOM may be compensated in the conventional technologies, and the compensation of the common voltage VCOM of the common electrode is a technique frequently be used in driving the display panel. As shown in FIG. 1, FIG. 1 is a diagram illustrating a conventional common voltage compensation circuit, the feedback point in the display panel is configured to lead back the feedback common voltage VCOM_FB. The alternating signals are connected to the inverting input end of the operation amplifier (OP) through the capacitor C1. The common voltage compensation signals VCOM_OUT are fed back, so as to conduct a compensation process. The common voltage compensation signals VCOM_OUT are configured to be a compensated common voltage and are inputted to the display panel. The reference common voltage VCOM_Ref is inputted to the non-inverting input end of the operation amplifier, and the reference common voltage VCOM_Ref may be derived from the power management circuit of the display panel. The conventional common voltage compensation circuit is mainly used to solve the problem of the horizontal crosstalk.

However, the compensation magnification is fixed. The ripple and the current of the common voltage VCOM are extremely great in the overload images, which may result in a great current after the compensation process and the overheating of the operational amplifier configured to compensate for the common voltage VCOM. In addition, the overcurrent protection (OCP) may be triggered.

SUMMARY OF THE INVENTION

The present disclosure relates to a common voltage feedback compensation circuit, a method, and a flat display device configured to solve the problem of the overheating during feedback compensation resulting from the ripple of the common voltage.

In one aspect, the present disclosure relates to a common voltage feedback compensation circuit, including: a switch selecting circuit, wherein a feedback common voltage is inputted to a first end of the switch selecting circuit, a first reference voltage is inputted to a second end of the switch selecting circuit, and a second reference voltage is inputted to a third end of the switch selecting circuit, the switch selecting circuit is configured to determine a range of the feedback common voltage received from a display panel according to the first reference voltage and the second reference voltage, and an output end of the switch selecting circuit is configured to output corresponding switch signals according to a determining result; a switch circuit, wherein the feedback common voltage is inputted to an input end of the switch circuit, an output end of the switch circuit connects to an input end of a compensation circuit, and the switch circuit is configured to be disconnected or closed according to the corresponding switch signals; an attenuation circuit, wherein the feedback common voltage is inputted to an input end of the attenuation circuit, and an output end of the attenuation circuit connects to an input end of the compensation circuit; when the switch circuit is disconnected, the feedback common voltage is inputted to and is attenuated by the attenuation circuit, and the attenuated feedback common voltage is outputted to the compensation circuit; when the switch circuit is closed, the feedback common voltage is directly inputted to the compensation circuit; the compensation circuit, wherein the input end of the compensation circuit connects to the output end of the switch circuit and the output end of the attenuation circuit, and an output end of the compensation circuit is configured to output common voltage compensation signals.

The switch selecting circuit includes: a first comparator, wherein a non-inverting input end of the first comparator is configured to receive the feedback common voltage, an inverting input end of the first comparator is configured to receive a first reference voltage, an output end of the first comparator is configured to output a first comparison result to a logical processor according to a comparison result between the feedback common voltage and the first reference voltage; a second comparator, wherein an inverting input end of the second comparator is configured to receive the feedback common voltage, a non-inverting input end of the second comparator is configured to receive a second reference voltage, the second comparator is configured to output a second comparison result to the logical processor according a comparison result between the feedback common voltage and the second reference voltage; the logical processor, wherein a first input end of the logical processor is configured to receive the first comparison result, a second input end of the logical processor is configured to receive the second comparison result, the logical processor is configured determine the range of the feedback common voltage according to the first comparison result and the second comparison result, and an output end of the logical processor is configured to output the corresponding switch signals to the switch circuit.

The switch circuit includes a transistor, an input end and an output end of the transistor respectively connect to the input end and the output end of the attenuation circuit, and the switch signals are inputted to a control end of the transistor.

The attenuation circuit includes: a first resistor, wherein one end of the first resistor connects to the input end of the attenuation circuit, and the other end of the first resistor connects to a non-inverting end of a first operation amplifier; a second resistor, wherein one end of the second resistor connects to the non-inverting end of the first operation amplifier, and the other end of the second resistor is grounded; the first operation amplifier, wherein an output end of the first operation amplifier connects to an inverting input end of the first operation amplifier and the output end of the attenuation circuit.

The compensation circuit includes a capacitor, a third resistor, a fourth resistor, and a second operation amplifier; one end of the capacitor connects to the output end of the attenuation circuit, the other end of the capacitor connects to one end of the third resistor, and the other end of the third resistor connects to an inverting input end of the second operation amplifier; one end of the fourth resistor connects to the inverting input end of the second operation amplifier, and the other end of the fourth resistor connects to an output end of the second operation amplifier; a reference common voltage is inputted to a non-inverting end of the second operation amplifier, and an output end of the second operation amplifier is configured to output the common voltage compensation signals.

The first reference voltage is less than the second reference voltage.

The logical processor is an AND gate unit.

When the feedback common voltage is greater than the first reference voltage and is less than the second reference, the switch circuit is closed; and when the feedback common voltage is less than or equal to the first reference voltage, or the feedback common voltage is greater than or equal to the second reference voltage, the switch circuit is disconnected.

In another aspect, the present disclosure relates to a flat display device, including any of the above common voltage feedback compensation circuit.

In another aspect, the present disclosure related to a feedback compensation method for a common voltage, including: determining a range of a feedback common voltage received from a display panel according to a first reference voltage and a second reference voltage via a switch selecting circuit; performing a common voltage compensation process with respect to the feedback common voltage directly by a compensation circuit upon determining the feedback common voltage is greater than the first reference voltage and is less than the second reference; attenuating the feedback common voltage to obtain the attenuated feedback common voltage by an attenuation circuit and performing the common voltage compensation process with respect to the attenuated feedback common voltage by the compensation circuit upon determining the feedback common voltage is less than or equal to the first reference voltage, or the feedback common voltage is greater than or equal to the second reference voltage.

In view of the above, the present disclosure relates to the common voltage feedback compensation circuit, the method, and the flat display device configured to increase the detection with respect to the ripple of the common voltage. When the ripple is too large, a ripple-reducing process may be conducted on the feedback common voltage to reduce the ripple, so as to solve the problem of the overheating during feedback compensation resulting from the ripple of the common voltage.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Figure 2:
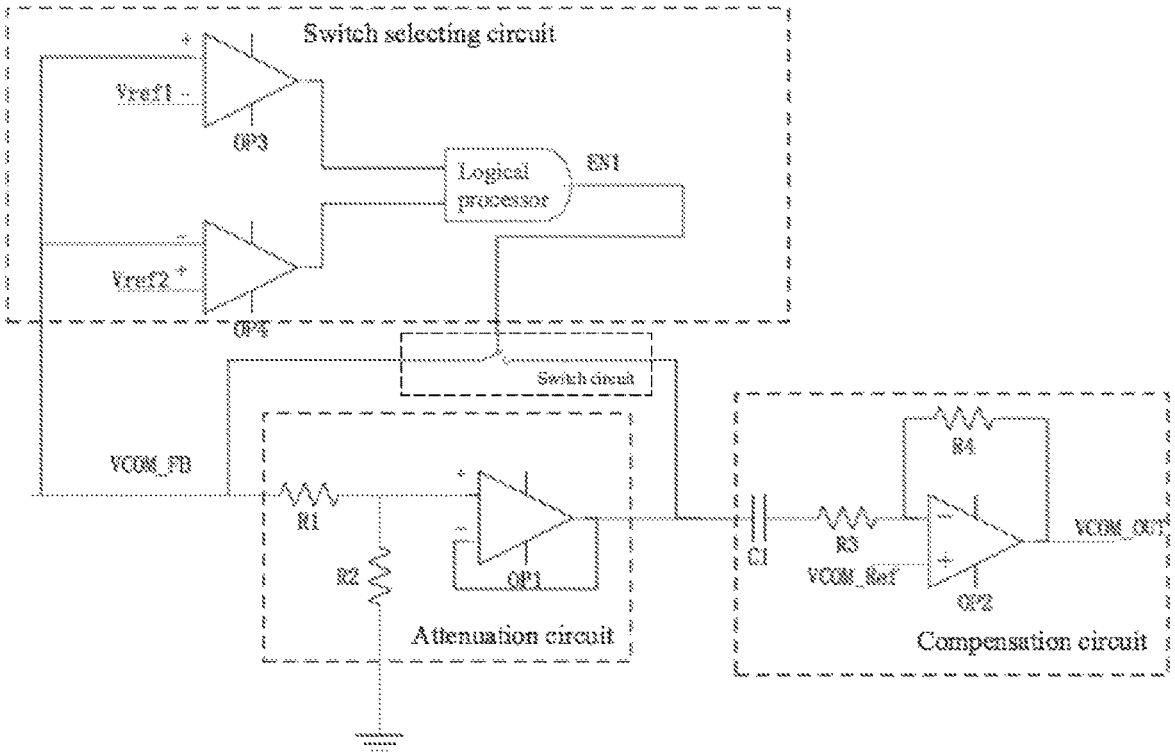
FIG. 2 is a diagram illustrating a common voltage feedback compensation circuit in accordance with one embodiment of the present disclosure.

Referring to FIG. 2, the present disclosure relates to a common voltage feedback compensation circuit, including: a switch selecting circuit, a switch circuit, an attenuation circuit, and a compensation circuit. The circuit shown in FIG. 2 is only for illustrating the present disclosure, and those skilled in the art can achieve various other corresponding changes and modifications according to the technical solutions and technical ideas of the present disclosure.

The switch selecting circuit is configured to determine a range of a feedback common voltage VOM_FB and to output corresponding switch signals. The switch selecting circuit may include a first comparator OP3, a second comparator OP4, and a logic processor. The feedback common voltage VCOM_FB is fed back from a feedback point of a display panel. The feedback common voltage VCOM_FB is inputted to a first end of the switch selecting circuit, a first reference voltage Vref1 is inputted to a second end of the switch selecting circuit, and a second reference voltage Vref2 is inputted to a third end of the switch selecting circuit. The switch selecting circuit is configured to compare a relative magnitude of the feedback common voltage VCOM_FB, and the first reference voltage Vref1 and the second reference voltage Vref2. The switch selecting circuit is further configured to determine a magnitude of a ripple by determining the range of the feedback common voltage VCOM_FB before conducting a common voltage compensation process, so as to generate the switch signals to control whether an attenuation process being conducted on the feedback common voltage VCOM_FB.

The feedback common voltage VCOM_FB is inputted to an input end of the switch circuit, and an output end of the switch circuit connects to an input end of the compensation circuit. The switch circuit may be disconnected or closed according to the corresponding switch signals EN1, so as to control the attenuation circuit to be turned on or turned off. In one example, the switch circuit may be a transistor. An input end and an output end of the transistor respectively connect to an input end and an output end of the attenuation circuit. The switch signals are inputted to a control end of the transistor. In another example, the transistor may be a n-metal-oxide-semiconductor (NMOS), other circuits, or components capable of performing the same functions. Taking NMOS as an example, when the NMOS is turned on by the switch signals EN1, the switch circuit is closed, and the switch circuit is close to a short circuit, which is equivalent to turn off the attenuation circuit which is in parallel with the switching circuit. When the NMOS is turned off by the switch signals EN1, the switch circuit is disconnected, and the switch circuit is close to an open circuit. The attenuation circuit, which is connected in parallel with the switching circuit, is configured to attenuate the feedback common voltage VCOM_FB.

The feedback common voltage VCOM_FB is inputted to an input end of the attenuation circuit, and the output end of the attenuation circuit connects to the input end of the compensation circuit. When the attenuation circuit is turned on, the feedback common voltage VCOM_FB is inputted to and is attenuated by the attenuation circuit, and the attenuated feedback common voltage VCOM_FB is outputted to the compensation circuit. When the attenuation circuit is turned off, the feedback common voltage VCOM_FB is directly inputted to the compensation circuit. An operation amplifier OP1 is the main component of an amplitude attenuation circuit of the feedback common voltage VCOM_FB.

The compensation circuit is configured to compensate for a common voltage VCOM. The input end of the compensation circuit simultaneously connects to the output end of the switch circuit and the output end of the attenuation circuit. As such, the feedback common voltage VCOM_FB or the attenuated feedback common voltage VCOM_FB may be inputted to the compensation circuit according to a status of the switch circuit. An output end of the compensation circuit is configured to output common voltage compensation signals VCOM_OUT. An second operation amplifier OP2 is the main component of the feedback compensation circuit of the common voltage VCOM. The common voltage compensation signals VCOM_OUT are inputted to the display panel as the compensated common voltage.

The ripple of the common voltage may be detected in the present disclosure. When the images of the panel is the overload images, the ripple may be too large and may be detected. A ripple-reducing process may be conducted on the feedback common voltage VCOM_FB before conducting a feedback compensation process.

In one example, the switch selecting circuit may include the first comparator OP3 and the second comparator OP4. The first comparator OP3 is configured to compare the feedback common voltage VCOM_FB with the first reference voltage Vref1, and to output a comparison result to the logical processor. The second comparator OP4 is configured to compare the feedback common voltage VCOM_FB with the second reference voltage Vref2. The comparison result obtained from the first comparator OP3 and the second comparator OP4 are respectively outputted to the logical processor. The logical processor is configured to determine the range of the feedback common voltage VCOM_FB, i.e., the magnitude of the ripple, according to the comparison result, and to output the corresponding switch signals to the switch circuit.

The predetermined first reference voltage Vref1 and the second reference voltage Vref2 are used to determine the magnitude of the ripple. When the first reference voltage Vref1 is less than the second reference voltage Vref2, the first reference voltage Vref1 may be inputted to an inverting input end of the comparator OP3, and the second reference voltage Vref2 is inputted to a non-inverting input end of the second comparator OP4. The logical processor is configured to determine the magnitude of the ripple according to a predetermined logic. In one example, the logical processor may be an AND gate unit.

The range of the ripple of the common voltage is determined by the switch selecting circuit. When the feedback common voltage VCOM_FB is greater than the first reference voltage Vref1 and is less than the second reference Vref2, that is, the current feedback common voltage VCOM_FB is determined to be small, a feedback process may directly be performed. The switch signals EN1 are configured to be at a high potential, the switch circuit is closed, the attenuation circuit is turned off, and the common voltage compensation process is directly performed.

When the feedback common voltage VCOM_FB is less than or equal to the first reference voltage Vref1, or the feedback common voltage VCOM_FB is greater than or equal to the second reference voltage Vref2, the switch signals EN1 are configured to be at a low potential, the switch circuit is disconnected, and the attenuation circuit is turned on. The feedback common voltage VCOM_FB may be pre-processed by the attenuation circuit to attenuate the feedback common voltage VCOM_FB before conducting the feedback process. As such, heating problems may be avoided, and an overcurrent protection (OCP) may not be triggered.

In one example, the attenuation circuit may include a first resistor R1, a second resistor R2, and the operation amplifier OP1. One end of the first resistor R1 connects to the input end of the attenuation circuit, and the other end of the first resistor R1 connects to the non-inverting end of the operation amplifier OP1. One end of the second resistor R2 connects to the non-inverting end of the operation amplifier OP1, and the other end of the second resistor R2 is grounded. An output end of the operation amplifier OP1 connects to the inverting input end of the operation amplifier OP1 and the output end of the attenuation circuit. In another example, the present disclosure may adopt other forms of the attenuation circuit suitable for attenuating the feedback common voltage VCOM_FB.

Figure 1:
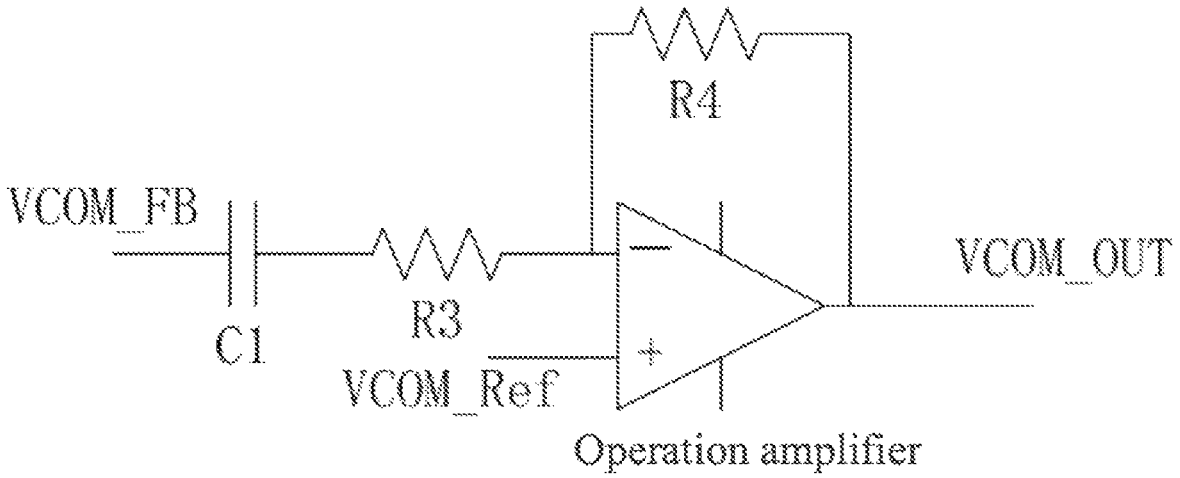
FIG. 1 PRIOR ART
FIG. 1 is a diagram illustrating a conventional common voltage compensation circuit.

In one example, the compensation circuit may include a capacitor C1, a third resistor R3, a fourth resistor R4, and the second operation amplifier OP2. One end of the capacitor C1 connects to the output end of the attenuation circuit, the other end of the capacitor C1 connects to one end of the third resistor R3, and the other end of the third resistor R3 connects to an inverting input end of the second operation amplifier OP2. One end of the fourth resistor R4 connects to the inverting input end of the second operation amplifier OP2, and the other end of the fourth resistor R4 connects to an output end of the second operation amplifier OP2. A reference common voltage VCOM_Ref is inputted to a non-inverting end of the second operation amplifier OP2, and an output end of the operation amplifier OP2 is configured to output the common voltage compensation signals VCOM_OUT. The operation principle of the compensation circuit is shown in FIG. 1.

In another aspect, the present disclosure further relates to a corresponding flat display device including the common voltage feedback compensation circuit described above.

In another aspect, the present disclosure further relates to a feedback compensation method for a common voltage basing on the common voltage feedback compensation circuit and the flat display device. The feedback compensation method may solve the problem of overheating during the common voltage feedback compensation in the prior art. The feedback compensation method includes the following steps.

Determining the range of the feedback common voltage VOM_FB received from the display panel according to the first reference voltage Vref1 and the second reference voltage Vref2 via the switch selecting circuit, and determining the range of the ripple of the common voltage according to the first reference voltage Vref1 and the second reference voltage Vref2 via the switch selecting circuit.

When the feedback common voltage VCOM_FB is greater than the first reference voltage Vref1 and is less than the second reference Vref2, the compensation circuit is configured to perform the common voltage compensation process with respect to the feedback common voltage VCOM_FB. When the ripple of the current feedback common voltage VCOM_FB is determined to be small, the attenuation circuit is turned off, and the feedback process is directly performed.

When the feedback common voltage VCOM_FB is less than or equal to the first reference voltage Vref1, or the feedback common voltage VCOM_FB is greater than or equal to the second reference voltage Vref2, the attenuation circuit is configured to attenuate the feedback common voltage VCOM_FB to obtain the attenuated feedback common voltage VCOM_FB, and the compensation circuit is configured to perform the common voltage compensation process with respect to the attenuated feedback common voltage VCOM_FB. When the ripple of the current feedback common voltage VCOM_FB is determined to be large, the attenuation circuit is turned on, and the feedback common voltage VCOM_FB is pre-processed by the attenuation circuit before conducting the feedback process.

In view of the above, the present disclosure relates to the common voltage feedback compensation circuit, the method, and the flat display device configured to increase the detection with respect to the ripple of the common voltage. When the ripple is too large, the ripple-reducing process may be conducted on the feedback common voltage to reduce the ripple, so as to solve the problem of the overheating during the feedback compensation resulting from the ripple of the common voltage.

Above are embodiments of the present invention, which does not limit the scope of the present invention. Any equivalent amendments within the spirit and principles of the embodiment described above should be covered by the protected scope of the invention.

What is claimed is:

1. A common voltage feedback compensation circuit, comprising:

a switch selecting circuit, wherein a feedback common voltage is inputted to a first end of the switch selecting circuit, a first reference voltage is inputted to a second end of the switch selecting circuit, and a second reference voltage is inputted to a third end of the switch selecting circuit, the switch selecting circuit is configured to determine a range of the feedback common voltage received from a display panel according to the first reference voltage and the second reference voltage, and an output end of the switch selecting circuit is configured to output corresponding switch signals according to a determining result;

a switch circuit, wherein the feedback common voltage is inputted to an input end of the switch circuit, an output end of the switch circuit connects to an input end of a compensation circuit, and the switch circuit is configured to be disconnected or closed according to the corresponding switch signals;

an attenuation circuit, wherein the feedback common voltage is inputted to an input end of the attenuation circuit, and an output end of the attenuation circuit connects to an input end of the compensation circuit; when the switch circuit is disconnected, the feedback common voltage is inputted to and is attenuated by the attenuation circuit, and the attenuated feedback common voltage is outputted to the compensation circuit; when the switch circuit is closed, the feedback common voltage is directly inputted to the compensation circuit;

the compensation circuit, wherein the input end of the compensation circuit connects to the output end of the switch circuit and the output end of the attenuation circuit, and an output end of the compensation circuit is configured to output common voltage compensation signals;

wherein the switch selecting circuit comprises:

a first comparator, wherein a non-inverting input end of the first comparator is configured to receive the feedback common voltage, an inverting input end of the first comparator is configured to receive a first reference voltage, an output end of the first comparator is configured to output a first comparison result to a logical processor according to a comparison result between the feedback common voltage and the first reference voltage;

a second comparator, wherein an inverting input end of the second comparator is configured to receive the feedback common voltage, a non-inverting input end of the second comparator is configured to receive a second reference voltage, the second comparator is configured to output a second comparison result to the logical processor according a comparison result between the feedback common voltage and the second reference voltage;

the logical processor, wherein a first input end of the logical processor is configured to receive the first comparison result, a second input end of the logical processor is configured to receive the second comparison result, the logical processor is configured determine the range of the feedback common voltage according to the first comparison result and the second comparison result, and an output end of the logical processor is configured to output the corresponding switch signals to the switch circuit.

2. The common voltage feedback compensation circuit according to claim 1, wherein the switch circuit comprises a transistor, an input end and an output end of the transistor respectively connect to the input end and the output end of the attenuation circuit, and the switch signals are inputted to a control end of the transistor.

3. The common voltage feedback compensation circuit according to claim 1, wherein the attenuation circuit comprises:

a first resistor, wherein one end of the first resistor connects to the input end of the attenuation circuit, and the other end of the first resistor connects to a non-inverting end of a first operation amplifier;

a second resistor, wherein one end of the second resistor connects to the non-inverting end of the first operation amplifier, and the other end of the second resistor is grounded;

the first operation amplifier, wherein an output end of the first operation amplifier connects to an inverting input end of the first operation amplifier and the output end of the attenuation circuit.

4. The common voltage feedback compensation circuit according to claim 1, wherein the compensation circuit comprises a capacitor, a third resistor, a fourth resistor, and a second operation amplifier;

one end of the capacitor connects to the output end of the attenuation circuit, the other end of the capacitor connects to one end of the third resistor, and the other end of the third resistor connects to an inverting input end of the second operation amplifier;

one end of the fourth resistor connects to the inverting input end of the second operation amplifier, and the other end of the fourth resistor connects to an output end of the second operation amplifier;

a reference common voltage is inputted to a non-inverting end of the second operation amplifier, and an output end of the second operation amplifier is configured to output the common voltage compensation signals.

5. The common voltage feedback compensation circuit according to claim 1, wherein the first reference voltage is less than the second reference voltage.

6. The common voltage feedback compensation circuit according to claim 5, wherein the logical processor is an AND gate unit.

7. The common voltage feedback compensation circuit according to claim 5, wherein when the feedback common voltage is greater than the first reference voltage and is less than the second reference, the switch circuit is closed; and when the feedback common voltage is less than or equal to the first reference voltage, or the feedback common voltage is greater than or equal to the second reference voltage, the switch circuit is disconnected.

8. A flat display device, comprising the common voltage feedback compensation circuit as claimed in claim 1.

* * * * *